US009246225B2

(12) United States Patent
Bilotti et al.

(10) Patent No.: US 9,246,225 B2
(45) Date of Patent: Jan. 26, 2016

(54) LOW-NOISE-FIGURE APERTURE ANTENNA

(71) Applicant: UNIVERSITA' DEGLI STUDI ROMA TRE, Rome (IT)

(72) Inventors: Filiberto Bilotti, Rome (IT); Alessandro Toscano, Rome (IT); Davide Ramaccia, Rome (IT); Luca Di Palma, Rome (IT)

(73) Assignee: UNIVERSITA' DEGLI STUDI ROMA TRE, Rome (IT)

( * ) Notice: Subject to any disclaimer, the term of this patent is extended or adjusted under 35 U.S.C. 154(b) by 356 days.

(21) Appl. No.: 13/733,503

(22) Filed: Jan. 3, 2013

(65) Prior Publication Data

US 2013/0169500 A1 Jul. 4, 2013

(30) Foreign Application Priority Data

Jan. 3, 2012 (IT) ..... RM2012A0003

(51) Int. Cl.

| | |
|---|---|
| ***H01Q 13/02*** | (2006.01) |
| ***H01P 1/201*** | (2006.01) |
| ***H01Q 15/00*** | (2006.01) |
| ***H01P 1/04*** | (2006.01) |

(52) U.S. Cl.

CPC ..... *H01Q 13/02* (2013.01); *H01P 1/042* (2013.01); *H01P 1/2016* (2013.01); *H01Q 15/006* (2013.01); *H01Q 15/0053* (2013.01)

(58) Field of Classification Search

CPC ..... H01Q 13/02
USPC ..... 343/786
See application file for complete search history.

(56) References Cited

U.S. PATENT DOCUMENTS

| | | | | |
|---|---|---|---|---|
| 2005/0099352 | A1* | 5/2005 | Killen et al. | 343/786 |
| 2010/0156573 | A1* | 6/2010 | Smith et al. | 333/239 |

FOREIGN PATENT DOCUMENTS

| | | |
|---|---|---|
| EP | 0905815 | 3/1999 |
| JP | 2111107 | 4/1990 |

OTHER PUBLICATIONS

Ran et al.; "Experimental study on several left-handed metamaterials" Progress in Electromagnetics Research Pier, vol. 51, Jan. 1, 2005, pp. 249-279.

(Continued)

*Primary Examiner* — Dameon E Levi
*Assistant Examiner* — Andrea Lindgren Baltzell
(74) *Attorney, Agent, or Firm* — Workman Nydegger

(57) ABSTRACT

Embodiments of the present invention concerns an aperture antenna that comprises: a receiving element, which includes an aperture and is configured to receive, through the aperture, radio signals having frequencies within a given band of radio frequencies; a waveguide configured to receive radio signals from the receiving element; and a frequency selective structure, which is arranged between the receiving element and the waveguide, and comprises metamaterial structures that extend partially inside the receiving element and/or partially inside the waveguide and that are configured to cause the propagation, from the receiving element to the waveguide, of only the received radio signals that have frequencies comprised within a predetermined sub-band of the given band of radio frequencies. Furthermore, the frequency selective structure is configured to reflect back into the receiving element the received radio signals that have frequencies not comprised in the predetermined sub-band.

10 Claims, 5 Drawing Sheets

(56) References Cited

OTHER PUBLICATIONS

Vahldieck et al.; "Finline and Metal Insert Filters with Improved Passband Separation and Increased Stopband Attenuation"; IEEE Transactions P on Microwave Theory and Techiques, New York, US, vol. 33, No. 12, Dec. 1, 1985, pp. 1333-1339.

Search Report from Italian Application No. RM2012A 000003 dated Jul. 13, 2012.

* cited by examiner

LOW-NOISE-FIGURE APERTURE ANTENNA

TECHNICAL FIELD

Embodiments of the present invention relates to a low-noise-figure aperture antenna that can be advantageously, but not exclusively, exploited in satellite communications, in particular in downlink satellite communications, to which the following description will make explicit reference, but without any loss in generality. In fact, embodiments of the present invention can also be advantageously exploited in other types of radio communications different from satellite communications and in radar system.

BACKGROUND

At present, reflector-type directive antenna systems that typically exploit horn antennas as feeding/receiving systems are used in satellite communications.

Horn antennas fall within the class of aperture antennas that, as is known, are antennas designed to radiate/receive radio signals through radiating/receiving apertures.

In particular, a horn antenna typically comprises:

- a hollow metal radiating/receiving element with a rectangular/square/circular cross-section, which
  - is known as a horn,
  - terminates, at a first end, with a radiating/receiving aperture, and
  - is configured to radiate/receive radio signals through the radiating/receiving aperture; and
- a waveguide, which is coupled to a second end of the radiating/receiving element and which is configured to receive radio signals received by the radiating/receiving element and/or to transmit radio signals to be radiated by the radiating/receiving element.

An example of aperture antennas is truncated waveguides used in antenna systems to radiate/receive radio signals, for example, in AESA (Active Electronically Scanned Array) antenna systems. In the case of a truncated waveguide, the radiating/receiving element is the end portion of the waveguide where the truncation is made that defines the radiating/receiving aperture.

As is known, satellite communications are implemented on radio channels characterized by bands of radio frequencies that are typically narrower than the operating bands of the horn antennas employed. These antennas are typically designed for wide-band operation, as the operating band of a horn antenna is directly connected to the monomodal bandwidth of the waveguide coupled to the horn.

Thus, a horn antenna, as it is characterized by an operating band typically wider than the radio frequency bands of the satellite channels, received both the narrow-band radio signals transmitted over the satellite channels and the noise present throughout the respective operating band. For this reason, horn antennas are characterized by a high noise figure. Regarding this, a longitudinal section of a traditional horn antenna 10 is shown schematically, and purely by way of example, in FIG. 1 (where the sizes shown are not to scale for simplicity of illustration).

In particular, in the example shown in FIG. 1, the horn antenna 10 is used in reception in a downlink satellite communication, i.e. a satellite communication in which the horn antenna 10 is used by a ground station located on the surface of the Earth (not shown in FIG. 1 for simplicity of illustration) to receive radio signals transmitted by an antenna system installed on board a satellite (not shown in FIG. 1 for simplicity of illustration).

In detail, as shown in FIG. 1, the horn antenna 10 comprises a horn 11 that, in use, picks up, or receives:

- a radio signal that has been transmitted by the antenna system installed on board the satellite (henceforth called useful signal, for simplicity of description) and which typically has a narrow-band spectrum S(f); and
- the noise that is present throughout the operating band of the horn 11, due to various factors and typically has a wide-band spectrum N(f).

In addition, always as shown in FIG. 1, the horn antenna 10 also comprises a waveguide 12 that is coupled to the horn 11 and that, in use, receives both the useful signal and noise from the horn 11.

FIG. 2 shows:

- the narrow-band spectrum S(f) of the useful signal that is received by the horn 11 and propagates in the waveguide 12; and
- the wide-band spectrum N(f) of the noise that is present in the operating band $B_1$ of the horn 11, is received by the horn 11 and also propagates in the waveguide 12.

Thus, the use of horn antennas in satellite communications entails an undesired increase in antenna noise temperature with a consequent deterioration of the signal-to-noise ratio.

Therefore, in consideration of the large distance between the satellites and the ground stations, atmospheric effects, ground noise and the high noise figure of horn antennas, current satellite communication systems are obliged to use, especially for downlink connections, additional filtering devices and specific signal processing systems designed to maximise the signal-to-noise ratio.

SUMMARY

The Applicant has felt the need to deal with the problem of the high noise figure of the horn antennas currently used for satellite communications. In consequence, the Applicant has carried in-depth research in order to develop an innovative low-noise-figure aperture antenna.

An object of one or more embodiments of the present invention is therefore that of providing a low-noise-figure aperture antenna.

The above-stated object is achieved by one or more embodiments of the present invention in so far as it relates to an aperture antenna and a reflector antenna system.

In particular, the aperture antenna according to an embodiment of the present invention comprises:

- a receiving element that includes an aperture and is configured to receive, through the aperture, radio signals having frequencies comprised within a given band of radio frequencies;
- a waveguide that is configured to receive radio signals from the receiving element; and
- a frequency selective structure that is arranged between the receiving element and the waveguide and comprises metamaterial structures that extend partially inside the receiving element and/or partially inside the waveguide and that are configured to cause the propagation, from the receiving element to the waveguide, of only the received radio signals that have frequencies comprised within a predetermined sub-band of the given band of radio frequencies.

In addition, the frequency selective structure is configured to reflect back into the receiving element the received radio signals that have frequencies not comprised in the predetermined sub-band.

Preferably, the frequency selective structure also comprises a metal wall that is arranged between the receiving element and the waveguide, is configured to reflect back into the receiving element the received radio signals that have frequencies not comprised in the predetermined sub-band, and comprises a slit. Furthermore, the metamaterial structures pass through the slit.

More preferably, the frequency selective structure also comprises a dielectric plate that passes through the slit in the metal wall and extends partially inside the receiving element and partially inside the waveguide. In addition, the metamaterial structures comprise a first metamaterial structure printed on a first face of the dielectric plate and a second metamaterial structure printed on a second face of the dielectric plate.

BRIEF DESCRIPTION OF DRAWINGS

For a better understanding of the present invention, some preferred embodiments, provided by way of explanatory and non-limitative example, will now be described with reference to the attached drawings (not to scale), where.

DETAILED DESCRIPTION

Figure 1:
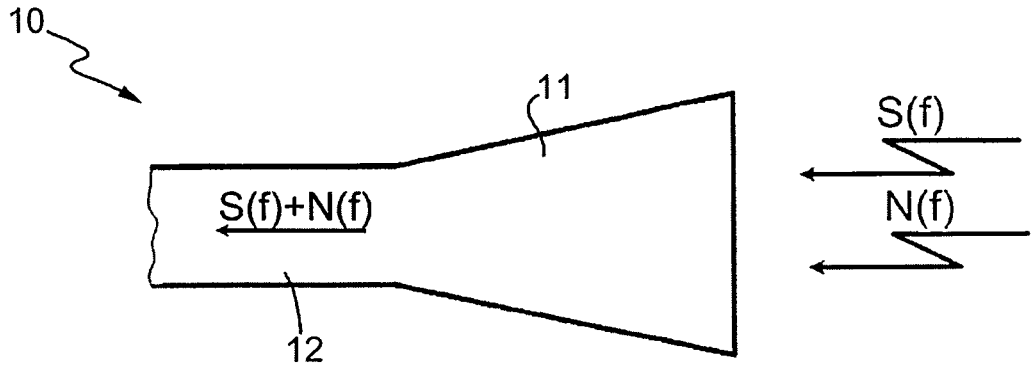
FIG. 1 schematically shows a longitudinal section of a traditional horn antenna used in reception in a downlink satellite communication.
Figure 2:
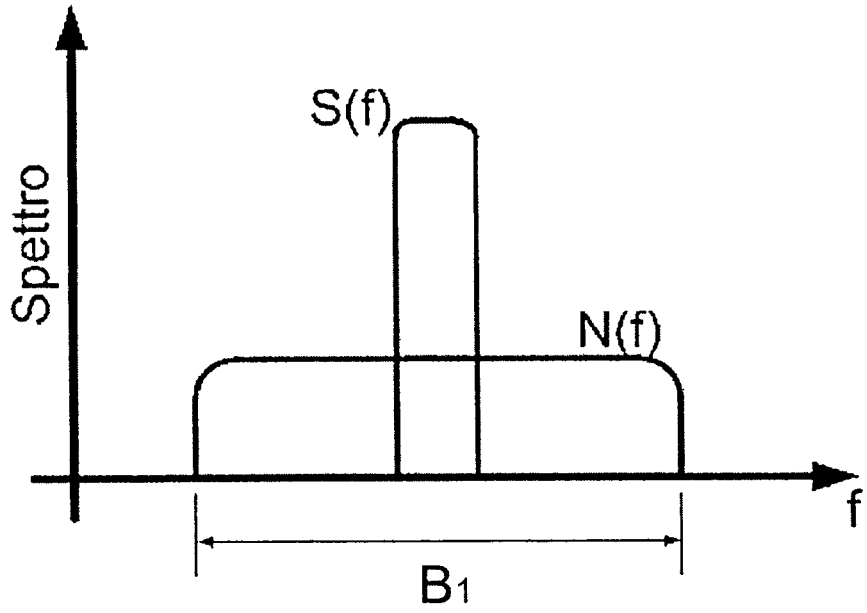
FIG. 2 schematically shows frequency spectrums of a useful signal and of noise received, in use, by the horn antenna shown in FIG. 1.

The following description is provided to enable an expert in the field to embody and use the invention. Various modifications to the embodiments presented will be readily apparent to experts in the field and the generic principles divulged herein may be applied to other embodiments and applications without, however, leaving the scope of protection of the present invention.

Thus, the present invention is not intended to be limited to just the embodiments described and shown herein, but is to be accorded the widest scope of protection consistent with the principles and features disclosed herein and defined in the appended claims.

Embodiments of the present invention relates to an innovative low-noise-figure aperture antenna.

In particular, embodiments of the present invention originates from an innovative idea of the applicant to exploit a structure based on metamaterials to increase the frequency selectivity of an aperture antenna and, in consequence, to reduce the noise figure of this antenna.

In detail, the applicant had the innovative idea of inserting a metamaterials-based frequency selective structure between a receiving element and a waveguide of an aperture antenna, so as to increase the frequency selectivity and, in consequence, reduce the noise figure of the antenna.

In detail, an aperture antenna according to an embodiment of the present invention comprises:

- a receiving element that includes an aperture and is configured to receive, through the aperture, radio signals having frequencies comprised within a given band of radio frequencies;
- a waveguide configured to receive radio signals from the receiving element; and
- a metamaterials-based frequency selective structure that is arranged between the receiving element and the waveguide and is configured to cause the propagation, from the receiving element to the waveguide, of only the received radio signals that have frequencies comprised within a predetermined sub-band of the band of radio frequencies receivable by the horn antenna.

The low-noise-figure aperture antenna according to one or more embodiments of the present invention can be advantageously exploited in a reflector antenna system comprising a reflecting system configured to reflect radio signals coming from one or more predetermined directions towards a respective focal area. In particular, the aperture antenna according to one or more embodiments of the present invention can be arranged in the focal area of the reflecting system so as to receive the radio signals reflected by the reflecting system.

Hereinafter, for simplicity of description, the aperture antenna according to embodiments of the present invention will be described by making explicit reference to satellite communications, in particular to downlink satellite communications. However, it is understood that the aperture antenna according to the present invention may also be advantageously exploited in uplink satellite communications, as well as in other types of communications and radio systems different from satellite ones.

Furthermore, hereinafter embodiments of the present invention will be described, always for simplicity of description, by making explicit reference to a horn antenna. However, it is understood that embodiments of the present invention can be advantageously exploited to produce any type of aperture antenna. For example, embodiments of the present invention can be advantageously exploited to produce low-noise-figure truncated waveguides to use in antenna systems to radiate/receive radio signals, for example, in AESA antenna systems.

According to a preferred embodiment of the present invention, a low-noise-figure horn antenna is provided.

In particular, while the horn in current horn antennas is typically coupled to the waveguide so that the junction between waveguide and horn does not have any discontinuities, in the horn antenna according to the preferred embodiment of the present invention, to the contrary, a metal wall is inserted at the junction section between the waveguide and the horn.

In detail, the metal wall is inserted at the junction section between the waveguide and the horn so as to be perpendicular to the direction of energy propagation, or rather of the radio signals, inside the waveguide and the horn.

The passage of power through the junction section is guaranteed by the presence of a vertical rectangular slit made in the center of the metal wall. A rectangular-shaped dielectric plate is inserted in the slit with its longer length in the direction of the axis of energy propagation.

The dielectric plate is centered on the junction section, with half of its length extending inside the waveguide and the other half extending inside the horn. In other words, an axis of symmetry of the dielectric plate is positioned on the junction section, or rather on the metal wall placed at the junction section, and is, in consequence, perpendicular to the energy propagation axis.

Two first, omega-shaped, electrically-small (i.e. with sizes a fraction of the wavelength of the radio signals radiated/received by the horn antenna), metallic metamaterial structures are printed on a first face of the dielectric plate such that they are symmetrical with respect to the axis of symmetry of the dielectric plate and are connected by a metallic metamaterial strip. One of the two first omega-shaped metamaterial metallizations lies on the part of the dielectric plate that is inside the waveguide, while the other first omega-shaped metamaterial metallization lies on the part of the dielectric plate that is inside the horn. The metallic metamaterial strip that connects the two first omegas extends laterally between the feet of the two first omegas facing the slit in the metal wall and passes through the slit. Furthermore, the metallic metamaterial strip that connects the two first omegas is parallel to the energy propagation axis and is perpendicular to the axis of symmetry of the dielectric plate.

Moreover, two second omega-shaped metallic metamaterial structures are printed on the second face of the dielectric plate that have the same sizes as the first omegas printed on the first face of the dielectric plate, are symmetrical with respect to the axis of symmetry of the dielectric plate and are also connected by a metallic metamaterial strip. One of the two second omega-shaped metamaterial metallizations lies on the part of the dielectric plate that is inside the waveguide, while the other second omega-shaped metamaterial metallization lies on the part of the dielectric plate that is inside the horn. The metallic metamaterial strip that connects the two second omegas extends laterally between the feet of the two second omegas facing the slit in the metal wall and passes through the slit. Furthermore, the metallic metamaterial strip that connects the two second omegas is parallel to the energy propagation axis and is perpendicular to the axis of symmetry of the dielectric plate. The two second metamaterial omegas are printed on the second face of the dielectric plate in a manner such that:

- the center of the second omega that is inside the waveguide coincides with the center of the first omega that is inside the waveguide;
- the center of the second omega that is inside the horn coincides with the center of the first omega that is inside the horn; and
- the second omegas and the first omegas are rotated by 180° with respect to each other, with reference to the energy propagation axis.

The so-conceived horn antenna is able to operate in a narrower band of radio frequencies with respect to that of a traditional horn antenna with the same geometric dimensions, whilst keeping the radiation characteristics more or less unchanged.

Figure 3:
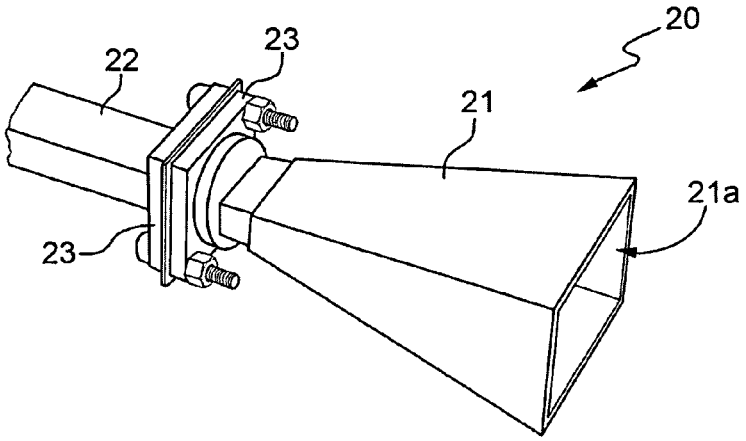
FIGS. 3 and 4 respectively show a perspective view and a schematic longitudinal section of a horn antenna according to a preferred embodiment of the present invention.

For a better understanding of the preferred embodiment of the present invention, a perspective view of a horn antenna 20 according to the preferred embodiment of the present invention is shown, purely by way of example, in FIG. 3.

In particular, as shown in FIG. 3, the horn antenna 20 comprises:

- a hollow metal radiating/receiving element 21, shaped like a truncated pyramid with rectangular bases, that
  - terminates, at a first end corresponding to the larger base of the truncated pyramid, with a rectangular radiating/receiving aperture 21*a*,
  - is configured to radiate/receive radio signals through the radiating/receiving aperture 21*a*, and
  - hereinafter will be called the horn, for simplicity of description; and
- a waveguide 22 that is coupled to a second end of the horn 21, specifically to the end of the horn 21 corresponding to the smaller base of the truncated pyramid; the waveguide 22 and the horn 21 being connected by respective coupling flanges 23 at which a junction section is thus defined between the waveguide 22 and the horn 21.

In detail, the waveguide 22 shown in FIG. 3 is a WR62 metal waveguide that operates in unimodal regime in the frequency range between 10 and 14 GHz and that, in use, receives the radio signals received by the horn 21 and/or provides radio signals to the horn 21 for transmission.

The junction section is parallel to the radiating/receiving aperture 21*a* and both are perpendicular to the direction of energy propagation, or rather of the radio signals, inside the waveguide 22 and the horn 21.

Figure 4:
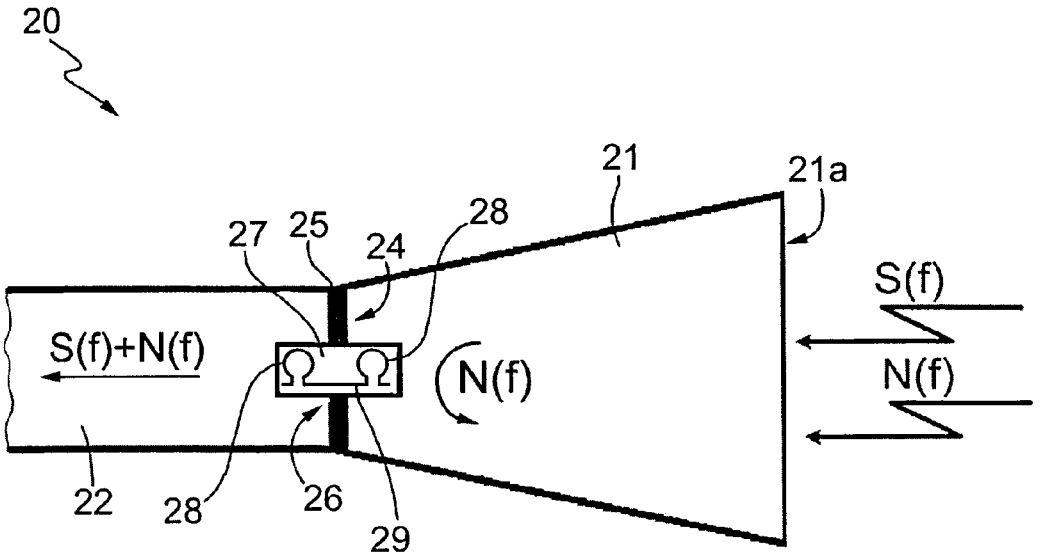

In order to describe the preferred embodiment of the present invention in even greater detail, a longitudinal section of the horn antenna 20 is shown, schematically and purely by way of example, in FIG. 4 (where the sizes shown are not to scale for simplicity of illustration), when the horn antenna 20 is used in reception in a downlink satellite communication, i.e. a satellite communication in which the horn antenna 20 is used by a ground station located on the surface of the earth (not shown in FIG. 4 for simplicity of illustration) to receive radio signals transmitted by an antenna system installed on board a satellite (not shown in FIG. 4 for simplicity of illustration).

In particular, as shown in FIG. 4, a metal shield 25 is inserted at the junction section (indicated by reference numeral 24 in FIG. 4) between the waveguide 22 and the horn 21, and connected to the waveguide 22 and the horn 21 by respective coupling flanges 23 (not shown in FIG. 4).

The passage of power through the junction section 24 is guaranteed by the presence of a vertical rectangular slit 26 made in the center of the metal shield 25. A rectangular-shaped dielectric plate 27 is inserted in the slit 26 with its longer length in the direction of the axis of energy propagation. The dielectric plate 27 is centered on the junction section 24, with half of its length extending inside the waveguide 22 and the other half extending inside the horn 21. In other words, the dielectric plate 27 is inserted in the slit 26 in a manner such that a respective axis of symmetry is positioned on the junction section 24, or rather on the metal shield 25 placed at the junction section 24. This axis of symmetry of the dielectric plate 27 is perpendicular to the energy propagation axis.

Two first, omega-shaped, electrically-small (for example, in the order of a tenth of the wavelength of the radio signals radiated/received by the horn antenna 20), metallic metamaterial structures 28 are printed on a first face of the dielectric plate 27, in particular on the face of the plate 27 shown in FIG. 4, such that they are symmetrical with respect to the axis of symmetry of the dielectric plate 27 and are connected by a metallic metamaterial strip 29. One of the two first omega-shaped metamaterial metallizations 28 lies on the part of the dielectric plate 27 that is inside the waveguide 22, while the other first omega-shaped metamaterial metallization 28 lies on the part of the dielectric plate 27 that is inside the horn 21. The metallic metamaterial strip 29 that connects the two first omegas 28 is constituted by the prolongation of the arms of the two first omegas 28 facing the slit 26 of the metal shield 25 and passes through the slit 26. Furthermore, the metallic metamaterial strip 29 that connects the two first omegas 28 is parallel to the energy propagation axis and is perpendicular to the axis of symmetry of the dielectric plate 27.

Moreover, two second omega-shaped metallic metamaterial structures are printed on the second face of the dielectric plate 27, in particular on the face of the plate 27 not shown in FIG. 4, which have the same sizes as the first omegas 28 printed on the first face of the dielectric plate 27, are symmetrical with respect to the axis of symmetry of the dielectric plate 27 and are also connected by a metallic metamaterial strip. One of the two second omega-shaped metamaterial metallizations lies on the part of the dielectric plate 27 that is inside the waveguide 22, while the other second omega-shaped metamaterial metallization lies on the part of the dielectric plate 27 that is inside the horn 21. The metallic metamaterial strip that connects the two second omegas is constituted by the prolongation of the arms of the two second omegas facing the slit 26 of the metal shield 25 and passes through the slit 26. Furthermore, the metallic metamaterial strip that connects the two second omegas is parallel to the energy propagation axis and is perpendicular to the axis of symmetry of the dielectric plate 27.

The two second metamaterial omegas are printed on the second face of the dielectric plate 27 in a manner such that:

- the center of the second omega that is inside the waveguide 22 coincides with the center of the first omega 28 that is inside the waveguide 22;
- the center of the second omega that is inside the horn 21 coincides with the center of the first omega 28 that is inside the horn 21; and
- the two second omegas and the two first omegas 28 are rotated by 180° with respect to each other, with reference to the energy propagation axis. In use, as shown in FIG. 4, the horn 21 picks up, or receives, through the radiating/receiving aperture 21*a:*
- a radio signal that has been transmitted by the antenna system installed on board the satellite (henceforth called the useful signal, for simplicity of description) and which typically has a narrow-band spectrum S(f); and
- noise that, due to various factors, is present throughout the operating band of the horn 21 and typically has a wide-band spectrum N(f).

Even though the horn 21 picks up both the useful signal and noise, only the contribution of the frequencies of the useful signal causes resonance of the first omegas 28 and the second omegas and enables the useful signal to pass through the slit 26 and be transmitted in the waveguide 22. The remaining spectrum components due to noise are reflected at the metal shield 25 and, consequently, are not transmitted in the waveguide 22. The resonance of the first omega-shaped inclusions 28 and the second omega-shaped inclusions is due to the excitation of:

- the rings, or loops, of the first omegas 28 and the second omegas by the magnetic field orthogonal to the axis of the rings; and
- the arms of the first omegas 28 and the second omegas by the electric field parallel to the arms.

In fact, the rings and arms of the first omegas 28 and the second omegas behave as small magnetic and electric dipoles, respectively, and therefore have frequency selective characteristics.

On the basis of what has just been described, it is apparent that the first omega inclusions 28 and the second omega inclusions are sensitive to the polarization of the electromagnetic field that transports the useful signal. If the horn antenna 20 is arranged according to the orientation shown in FIG. 4, the horn antenna 20 receives vertical polarization, whilst, if it is rotated by 90°, it receives horizontal polarization.

By using square or circular section horns and using two omega-shaped inclusions arranged orthogonally to each other, it is possible to receive in dual polarization or in circular polarization.

By using two or more sets of omega-shaped inclusions, it is also possible to receive on several frequency bands.

Therefore, the horn antenna 20 is a low-noise-figure antenna that, by being equipped with an integrated frequency filter represented by the first and second omega-shaped inclusions, selects the portion of the spectrum that contains the useful signal summed to a small noise portion, specifically the noise portion present in the same band of radio frequencies of the useful signal, drastically reducing the noise contribution and, in this way, enabling optimal reception of the useful signal.

Figure 5:
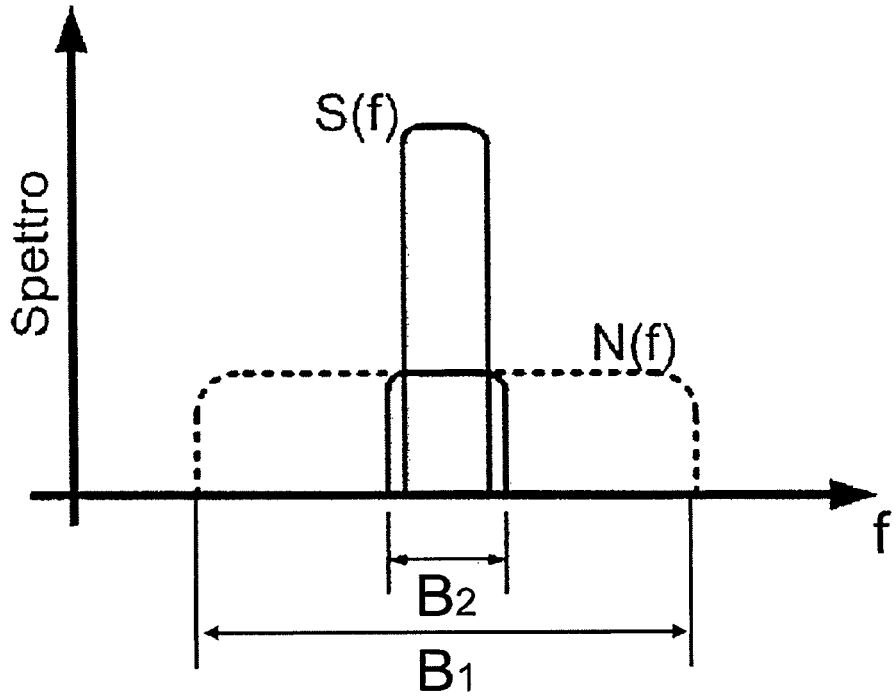
FIG. 5 schematically shows frequency spectrums of a useful signal and of noise received, in use, by the horn antenna shown in FIGS. 3 and 4.

Regarding this, FIG. 5 shows:

- the narrow-band spectrum S(f) of the useful signal that is received by the horn 21, made to pass through the slit 26 of the metal shield 25 by the first metallic metamaterial omegas 28 and by the second metallic metamaterial omegas and, in consequence, propagates in the waveguide 22;
- the wide-band spectrum N(f) of the noise (represented in FIG. 5 by a broken line) that is present in the operating band $B_1$ of the horn 21, is received by the horn 21 and is reflected by the metal shield 25; and
- the portion of the wide-band spectrum N(f) of the noise that is present in the same frequency band of the useful signal, or rather in an operating band $B_2$ of the horn antenna 20, and that is received by the horn 21, is made to pass through the slit 26 of the metal shield 25 by the first metallic metamaterial omegas 28 and by the second metallic metamaterial omegas and, inconsequence, propagates in the waveguide 22.

Figure 6:
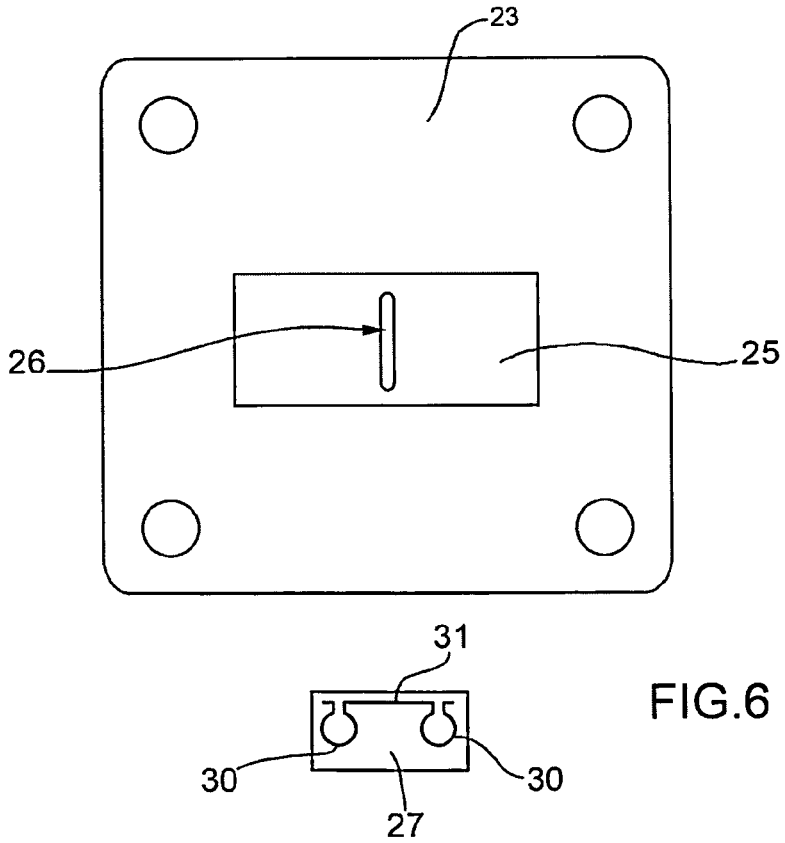
FIGS. 6 and 7 show front views of specific components of the horn antenna shown in FIGS. 3 and 4.

A front view of the metal shield 25 and the respective coupling flange 23 is shown in FIG. 6. As shown in FIG. 6, the rectangular slit 26 is made at the center of the metal shield 25.

In addition, FIG. 6 also shows the dielectric plate 27. As previously described, in use, the dielectric plate 27 is arranged in the slot 26 in a manner such that the respective axis of symmetry is positioned on the metal shield 25 that, in turn, and in use, is placed at the junction section 24.

In particular, FIG. 6 shows the second face of the dielectric plate on which the second omegas are printed (indicate by reference numeral 30 in FIG. 6), which, as previously described, are connected by a metallic metamaterial strip (indicate by reference numeral 31 in FIG. 6) and which are printed on the second face of the dielectric plate 27 in a manner such that, in use:

- the center of the second omega 30 that is inside the waveguide 22 coincides with the center of the first omega 28 that is inside the waveguide 22;
- the center of the second omega 30 that is inside the horn 21 coincides with the center of the first omega 28 that is inside the horn 21; and
- the two second omegas 30 and the two first omegas 28 are rotated by 180° with respect to each other, with reference to the energy propagation axis.

Figure 7:
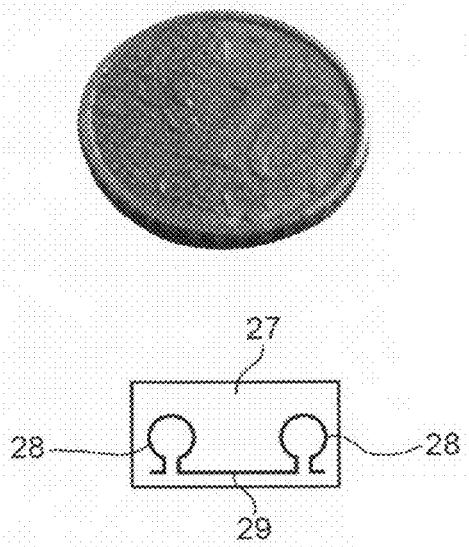

In addition, the dielectric plate 27 is shown in FIG. 7 (in particular, the first face of the dielectric plate 27 is shown in FIG. 7), together with a ten eurocent coin to give a better idea of the effective size of this dielectric plate 27.

The applicant has constructed a prototype of the previously described horn antenna 20 shown in FIGS. 3 and 4 in order to measure the electromagnetic characteristics. In particular, the applicant used a vector network analyser to obtain the adaptation characteristics of a traditional horn antenna, in particular, of the previously described horn antenna 10 shown in FIG. 1 and of horn antenna 20.

Figure 8:
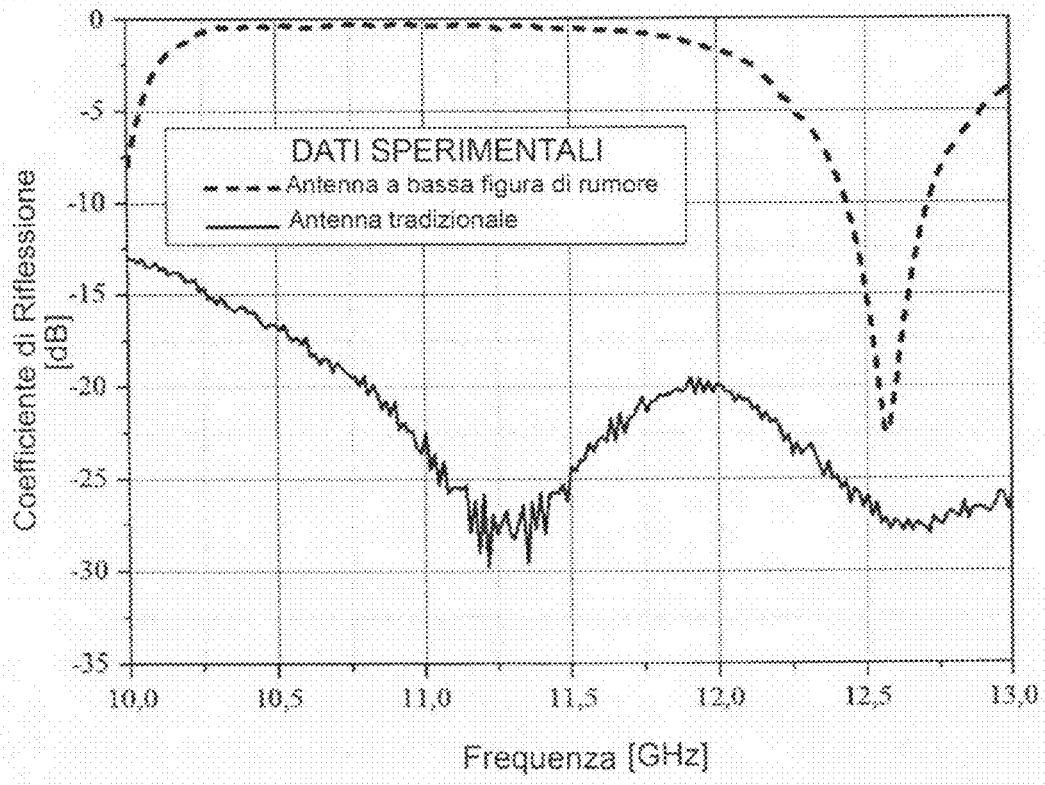
FIGS. 8 and 9 schematically show comparisons between the respective electromagnetic characteristics of the horn antenna shown in FIG. 1 and the horn antenna shown in FIGS. 3 and 4.

Regarding this, FIG. 8 shows a comparison between the adaptation characteristics of the traditional horn antenna 10 and of horn antenna 20.

In particular, FIG. 8 shows a graph of the reflection coefficient at the input port of the traditional horn antenna 10 (indicated as a traditional antenna in FIG. 8) and of horn antenna 20 (indicated as a low-noise-figure antenna in FIG. 8) as a function of frequency.

In detail, as shown in FIG. 8, the traditional horn antenna 10 has a bandwidth (estimated with a typical threshold of −10 dB) of between 10 and 13 GHz, while the horn antenna 20 according to the preferred embodiment of the present invention has a reflection coefficient of less than −10 dB in a narrow band centered around 12.5 GHz (i.e. the operating band $B_2$ of the horn antenna 20). Therefore, the traditional horn antenna 10 is not able to select a narrow-band signal and also picks up noise outside of the useful signal in an efficient manner. Instead, the horn antenna 20 according to the preferred embodiment of the present invention is able to pick up the narrow-band signal, whilst reflecting all the spectral contributions of noise outside the band of the useful signal, guaranteeing a better signal-to-noise ratio and better satellite signal reception.

Figure 9:
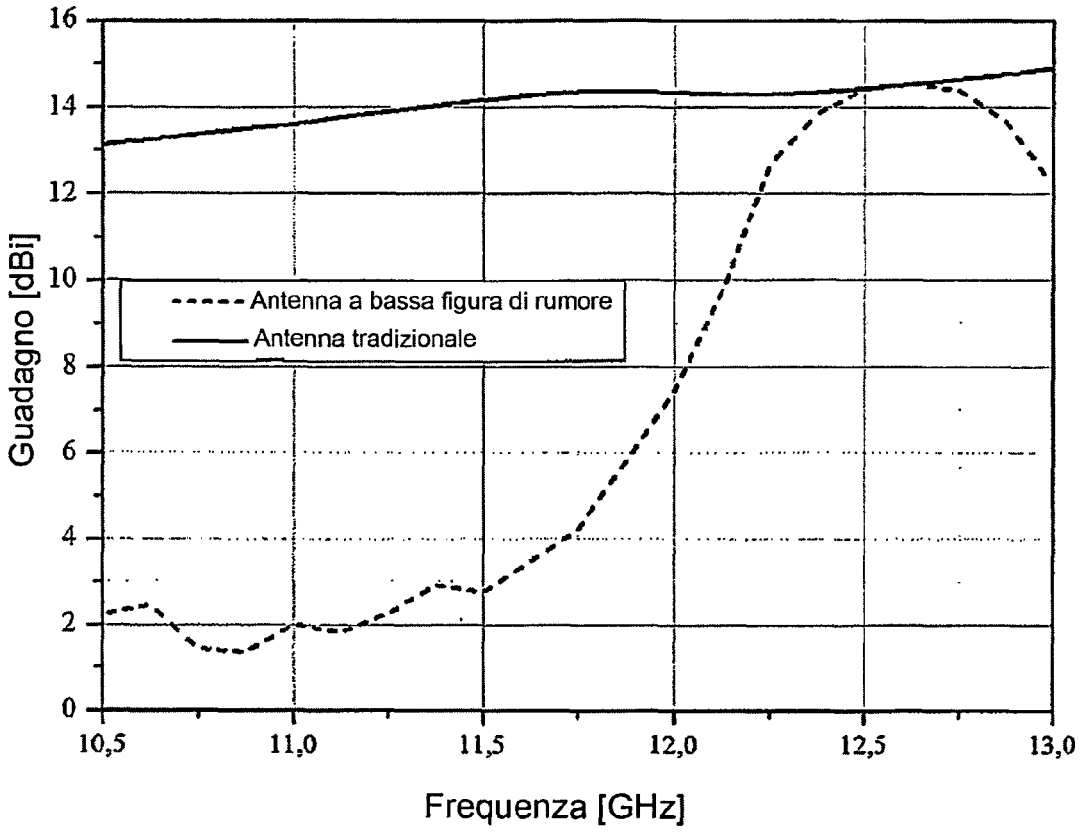

In FIG. 9, a graph is shown of the gain of the traditional horn antenna 10 (indicated again as a traditional antenna in FIG. 9) and of horn antenna 20 (indicated again as a low-noise-figure antenna in FIG. 9) as a function of frequency. As shown in FIG. 9, in a narrow band centered around 12.5 GHz (i.e. in the operating band $B_2$ of the horn antenna 20) the gain values of the horn antenna 20 are similar to those of the traditional horn antenna 10.

The low-noise-figure aperture antenna according to one or more embodiments of the present invention can be advantageously, but not exclusively, used as a feeding/receiving system in reflector antenna systems for satellite communications, for example, operating in the Ku, K and Ka bands.

In particular, the low-noise-figure aperture antenna according to an embodiment of the present invention, by operating in a narrow band and maintaining the same characteristics of a traditional feeding/receiving system in this operating band, enables the signal-to-noise ratio in downlink satellite communications to be improved. In any case, the embodiments of the present invention can also be advantageously used in uplinks using several omega-shaped structures of different sizes so as to guarantee operation of the aperture antenna in two distinct bands, specifically in a first band used for downlinks and in a second band used for uplinks. Embodiments of the present invention can also be advantageously exploited in other types of communications and radio systems different from satellite ones.

The advantages of one or more embodiments of the present invention can be immediately appreciated from the foregoing description.

In particular, it is important to underline yet again the fact that the low-noise-figure aperture antenna according to one or more embodiments of the present invention permits maximizing the signal-to-noise ratio while maintaining the same electromagnetic characteristics of a traditional aperture antenna in its operating band.

Furthermore, the low-noise-figure aperture antenna according to one or more embodiments of the present invention has the same dimensions and the same bulk of a traditional aperture antenna. This allows complete interoperability with previously designed antenna systems that, with a few low-cost modifications, can be upgraded. In fact, the printing of the metamaterial omegas has low production costs and times and the integration of these omegas in existing antenna systems is not particularly laborious.

The low-noise-figure aperture antenna according to the present invention can be used for downlink and/or uplink satellite communications and/or for other types of communications and radio systems different from satellite ones.

With regard to satellite communications, the low-noise-figure aperture antenna according to one or more embodiments of the present invention guarantees a lower cost for the feeding/receiving system of reflector antenna systems for satellite communications thanks to the fact that the horn antenna does not need to be followed by a filter component necessary for eliminating the out-of-band noise contributions.

Furthermore, since there is no longer a need for a filter component to eliminate the out-of-band noise contributions, the low-noise-figure aperture antenna according to one or more embodiments of the present invention also guarantees greater compactness of the overall satellite communications system, with significant advantages in terms of bulk and weight.

However, the aperture antenna according to one or more embodiments of the present invention is characterized by a decidedly lower noise figure with respect to a traditional feeding/receiving system of the same size.

Finally, it is clear that various modifications can be made to the present invention without leaving the scope of protection of the invention as defined in the appended claims.

The invention claimed is:

1. An aperture antenna, comprising:

a receiving element, which includes an aperture and is configured to receive, through the aperture, radio signals having frequencies within a given band of radio frequencies; a waveguide, which is configured to receive radio signals from the receiving element; and a frequency selective structure, which is arranged between the receiving element and the waveguide, and is configured to cause the propagation, from the receiving element to the waveguide, of only the received radio signals that have frequencies comprised within a predetermined sub-band of the given band of radio frequencies;

wherein the frequency selective structure comprises:

a metal wall that is arranged between the receiving element and the waveguide in a junction region, the metal wall being configured to reflect back into the receiving element the received radio signals that have frequencies not comprised in the predetermined sub-band;

a slit that is located in the metal wall, the metal wall extending in a direction perpendicular to the direction of propagation of the received radio in the junction region such that received radio signals are propagated through the slit; and metamaterial structures that pass through the slit and that extend partially inside the receiving element or partially inside the waveguide.

2. The aperture antenna according to claim 1, wherein the slit is arranged generally at a center of the metal wall.

3. The aperture antenna according to claim 1, wherein the frequency selective structure further comprises a dielectric plate, which passes through the slit in the metal wall and extends partially inside the receiving element and partially inside the waveguide; and wherein the metamaterial structures comprise a first metamaterial structure printed on a first face of the dielectric plate and a second metamaterial structure printed on a second face of the dielectric plate.

4. The aperture antenna according to claim 3, wherein the first metamaterial structure comprises:

a first metamaterial element printed on a first portion of the first face of the dielectric plate, the first portion extending inside the receiving element;

a second metamaterial element printed on a second portion of the first face of the dielectric plate, the second portion extending inside the waveguide; and a first metamaterial strip connecting the first metamaterial element and the second metamaterial element, and printed on a third portion of the first face of the dielectric plate, the third portion passing through the slit in the metal wall and extending partially inside the receiving element and partially inside the waveguide; and wherein the second metamaterial structure comprises:

a third metamaterial element printed on a first portion of the second face of the dielectric plate, the first portion extending inside the receiving element;

a fourth metamaterial element printed on a second portion of the second face of the dielectric plate, the second portion extending inside the waveguide; and a second metamaterial strip connecting the third metamaterial element and the fourth metamaterial element, and printed on a third portion of the second face of the dielectric plate, the third portion passing through the slit in the metal wall and extending partially inside the receiving element and partially inside the waveguide.

5. The aperture antenna according to claim 4, wherein the first, second, third, and fourth metamaterial elements are omega-shaped; and wherein a center of the first omega-shaped metamaterial element corresponds to a center of the third omega-shaped metamaterial element;

a center of the second omega-shaped metamaterial element corresponds to a center of the fourth omega-shaped metamaterial element; and the first and second metamaterial structures are rotated by about 180° with respect to each other, with reference to the direction of propagation of the radio signals inside the receiving element and the waveguide.

6. The aperture antenna according to claim 5, wherein the first and the third omega-shaped metamaterial elements each comprise a respective first foot facing the slit in the metal wall and a respective second foot facing the inside of the receiving element;

wherein the second and the fourth omega-shaped metamaterial elements each comprise a respective first foot facing the slit in the metal wall and a respective second foot facing the inside of the waveguide;

wherein the first metamaterial strip connects the first feet of the first and second omega-shaped metamaterial elements; and wherein the second metamaterial strip connects the first feet of the third and fourth omega-shaped metamaterial elements.

7. The aperture antenna according to claim 1, wherein the metamaterial structures are configured to cause the propagation, from the receiving element to the waveguide, of only the received radio signals that have frequencies within the predetermined sub-band and that are polarized according to horizontal or vertical polarization.

8. The aperture antenna according to claim 1, wherein the metamaterial structures are configured to cause the propagation, from the receiving element to the waveguide, of only the received radio signals that have frequencies within the predetermined sub-band and that are polarized according to two different polarizations or according to circular polarization.

9. The aperture antenna according to claim 1, wherein the metamaterial structures are configured to cause the propagation, from the receiving element to the waveguide, of only the received radio signals that have frequencies within a plurality of predetermined sub-bands of the given band of radio frequencies.

10. A reflector antenna system comprising:

a reflecting system, which is configured to reflect radio signals coming from one or more predetermined directions towards a respective focal area; and the aperture antenna according to claim 1, the aperture antenna being arranged in the focal area of the reflecting system so as to receive the radio signals reflected by the reflecting system.

* * * * *